United States Patent [19]

Hayakawa

[11] Patent Number: 4,915,428

[45] Date of Patent: Apr. 10, 1990

[54] DOOR LOCK SYSTEM OF A VEHICLE

[75] Inventor: Hatsuo Hayakawa, Yokohama, Japan

[73] Assignee: Ohi Seisakusho Co., Ltd., Kanagawa, Japan

[21] Appl. No.: 211,549

[22] Filed: Jun. 24, 1988

[30] Foreign Application Priority Data

Jun. 26, 1987 [JP] Japan ..... 62-157505

[51] Int. Cl.[4] ..... E05C 3/10

[52] U.S. Cl. ..... 292/29; 292/DIG. 46; 292/DIG. 17; 292/304; 292/DIG. 55

[58] Field of Search ..... 292/216, 280, 29, 30, 292/304, DIG. 46, DIG. 5, DIG. 39, DIG. 40, DIG. 55, DIG. 17, 100, 126

[56] References Cited

U.S. PATENT DOCUMENTS

| | | | |
|---|---|---|---|
| 1,908,387 | 5/1933 | Watson | 292/DIG. 40 X |
| 2,253,660 | 8/1941 | Tell | 292/29 X |
| 3,004,788 | 10/1961 | Dully et al. | 292/DIG. 5 X |
| 4,064,652 | 12/1977 | Johnson | 292/DIG. 17 X |
| 4,548,434 | 10/1985 | Princell | 292/DIG. 5 X |
| 4,580,823 | 4/1986 | Yamada et al. | 292/DIG. 46 X |
| 4,632,440 | 12/1986 | Adrian et al. | 292/304 X |

FOREIGN PATENT DOCUMENTS

| | | | |
|---|---|---|---|
| 1190834 | 4/1965 | Fed. Rep. of Germany | 292/DIG. 55 |
| 48-33125 | 10/1973 | Japan . | |
| 60-40482 | 3/1985 | Japan . | |

*Primary Examiner*—Richard E. Moore

*Attorney, Agent, or Firm*—Lowe, Price, LeBlanc, Becker & Shur

[57] ABSTRACT

A door lock system of a vehicle which comprises a member having a recessed portion which is provided at either one of an end face of a vehicle body and an end face of a door which confront each other when the door is in its closed position; and a member having a projected portion which is provided at the other of the end faces; the projected portion having a guide slot and an engaging slot; the recessed portion having a guide pin with a tapered end portion which is adapted to be guided into the guide slot and a hook member which is engageable with the engaging slot and connected to a door lock opening/closing device to lock the hook member at a locking portion provided at an end of the engaging slot.

8 Claims, 3 Drawing Sheets

DOOR LOCK SYSTEM OF A VEHICLE

A. FIELD OF THE INVENTION

This invention relates to a door lock system of a vehicle suitably usable for a forward lock of a sliding door of a vehicle or a lock of a back door of the vehicle.

B. RELATED ARTS

In general, a sliding door has a door lock opening/-closing device which is operatively connected to an outside handle provided on an external side of the sliding door and an inside handle provided on an internal side of the sliding door and a rearward door lock device which is provided at a rearward portion of the sliding door and connected to the door lock opening/closing device.

The rearward door lock device is constructed in such a way that it is adapted to engage with a striker fixed to a vehicle body at the rear of the door. The rear door lock device is engaged with and disengaged from the striker to close and open the door.

In the sliding door as mentioned above, when the door receives a lateral or transverse load, the rear portion of the door may withstand the load since it is firmly supported through the engagement between the rearward door lock device and the striker, while the fore portion of the door will be rather easily yielded to the load because it is supported not sufficiently but only by a slide guiding means provided on the door or the vehicle body.

To solve this problem, i.e., to hold the door more positively for preventing undesired easy opening of the door when the door is deformed, for example, by collision, the guide means or door should be made thicker to increase the strength and firmness This solution, however, is not desirable to meet another requirement that the size and weight of the vehicle be reduced. Therefore, various devices have been further proposed to solve the problems, in which a forward door lock is provided at a forward portion of the sliding door to strengthen the support of the door at the fore portion of the door.

Such a forward door lock device is disclosed, for example, in Japanese Utility Model Application Publication (Kokoku) No. 48-33125 and Japanese Patent Application Laid-Open (Kokai) No. 60-40482.

The former device comprises a pin hole formed on the vehicle body side, in which a ring of a resilient material is fitted, and a projecting pin provided on the door side, which is engageable with the pin hole. When the door is closed, the pin engages with the pin hole, which prevents rattling of the door.

The latter device comprises a striker which is fixed at a front pillar of the vehicle body and a hook member which is provided on the door and operatively connected to a door lock opening/closing device and adapted to be operated by an outside handle and an inside handle provided on the door. When the door is closed, the hook member engages with the striker, which enhances the supporting strength of the door.

The above-mentioned conventional forward door lock device, however, can not have sufficient supporting strength when a load is applied to the door laterally or transversely. In especial, since the former ,device with the pin has no locking means, the pin may easily be disengaged from the pin hole when the door is deformed.

In the latter device with the striker and hook, additional means for positioning should be provided on the pillar and the door so as to cope with vertical/horizontal misalignment or divergence in position of the door which might be caused by a change with time.

SUMMARY OF THE INvENTION

The invention has been made to obviate the problems involved in the prior arts and it is an object of the present invention to provide a door lock system for vehicle which is capable of improving the strength of the engagement between the door and the vehicle body and capable of preventing the positional misalignment or divergence between the door and the vehicle body.

The present invention features a door lock system of a vehicle which comprises a door lock opening/closing device which is operatively connected to operating means provided on a door; a member having a recessed portion which is provided at either one of an end face of a vehicle body and an end face of a door which confront each other when the door is in its closed position; and a member having a projected portion which is provided at the other of the end faces; the projected portion having a guide slot and an engaging slot having a locking portion provided at an end thereof; the recessed portion having a guide pin with a tapered end portion which is adapted to be guided into the guide slot and a hook member which is engageable with the engaging slot and connected to the door lock opening/closing operating device to lock the hook member at the locking portion.

The door lock system preferably have an integrally molded rigid synthetic resin member which covers periphery of the guide slot and the locking portion of the engaging slot.

The door lock system of the present invention is applied, for example, to a forward lock of a sliding door of the vehicle or to a back door of the vehicle.

The sliding door, preferably, further has a rearward lock which is also connected operatively to the door lock opening/closing device and said forward lock and rearward lock are adapted to be released at the same time by operating the operating means of the door.

The member having the recessed portion, preferably, has an elongated slot at said recessed portion and said hook member has a rear end portion which extends through said elongated slot of the base member, is rotatably supported by a pin at a bracket connected to the base member and is urged toward a lock position.

The recessed portion is, preferably, formed deeper in its inner end and shallower at its outer end so that the guide pin and the hook member extend slightly towards the inside of the vehicle and said projected portion is formed higher at its inner end and lower at its outer end so that the engaging slot and said guide slot face slightly outward, whereby said guide pin and said hook member may be engaged with and disengaged from said guide slot and said engaging slot, respectively, in parallel.

The member having the projected portion preferably has another projected member which projects in a direction opposite to that of said projected portion thereby to form a space for receiving the guide pin and the hook member therein.

The guide pin preferably has a tapered tip end portion and a stem portion.

OPERATION

When the door is closed, the guide pin is gradually guided, from its tapered tip end through its stem, into the guide slot and the door is simultaneously guided to its predetermined closing position relative to the vehicle body. Thus, the positioning of the door is attained.

The hook member is inserted in the engaging slot and engages with the locking portion formed at an end of the engaging slot. This prevents the door from being opened.

The projected portion and the recessed portion provided on the confronting faces of the door and the vehicle body engage with each other and this engagement further assure the coupling between the door and the vehicle body, strengthening the coupling.

When the door is closed, the guide pin is inserted into the guide slot and the hook member engages with the locking portion to attain a primary coupling between the door and the vehicle body and, in addition to this, the projected portion engages with the recessed portion to provide a further coupling between the vehicle body and the door, reinforcing the engagement between the door and the vehicle body against a large external force which is caused, for example, by an accidental collision.

When the hook is released from the locking portion of the engaging slot by the door lock opening/closing operating device, the door may be opened freely.

When the door is opened, the guide pin is disengaged from the guide slot and, at the same time, the hook member is disengaged from the engaging slot.

DESCRIPTION OF PREFERRED EMBODIMENT

Figure 1:
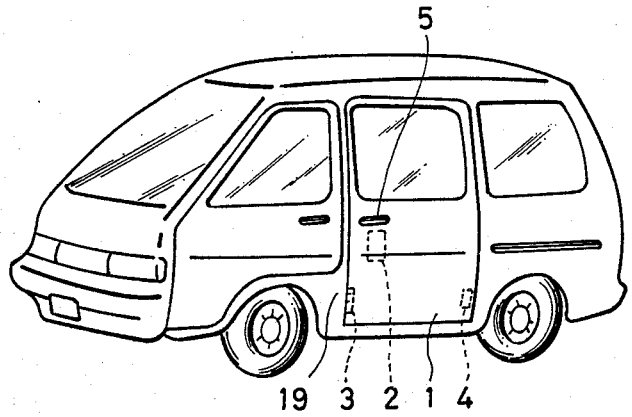
FIG. 1 is a view showing an external appearance of a vehicle to which the present invention is applied.

An embodiment of the present invention, which is applied to a forward door lock of a sliding door of a vehicle such as an automobile, will now be described, while referring to the drawings.

Figure 2:
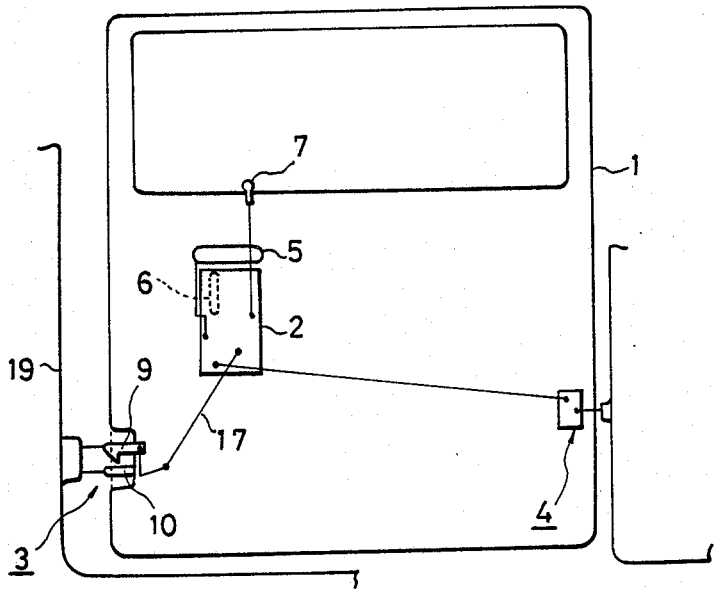
FIG. 2 is a schematic view showing a general formation of a lock mechanism for a sliding door.
Figure 3:
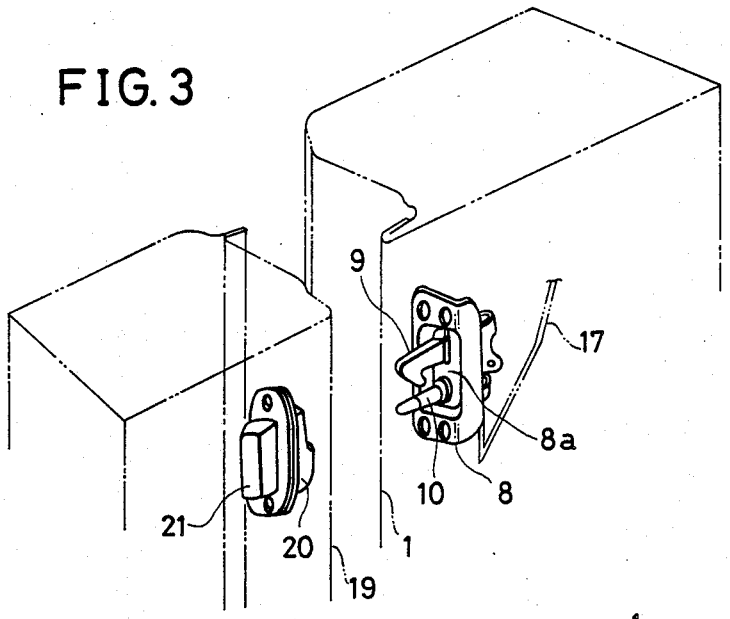
FIG. 3 is a perspective view of a forward door lock device with the sliding door opened a bit as viewed obliquely backward.
Figure 4:
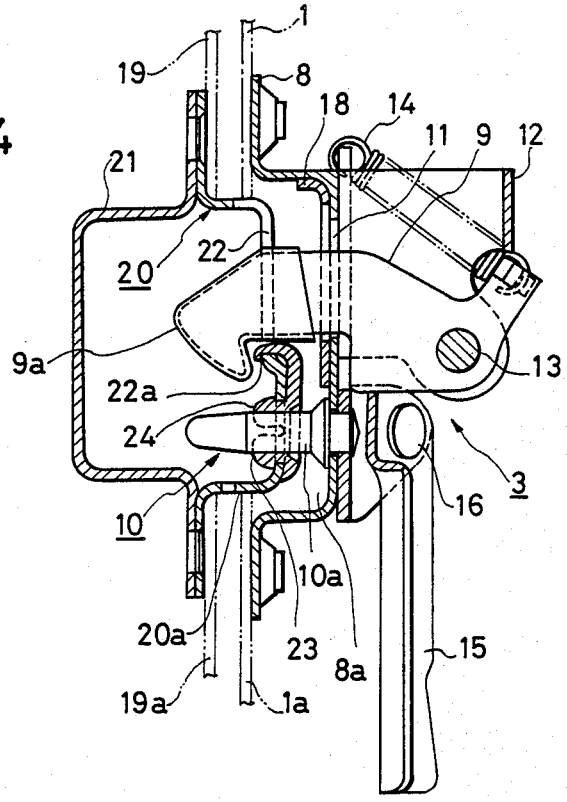
FIG. 4 is a vertical cross section of the forward door lock device in the position when the sliding door is closed.
Figure 5:
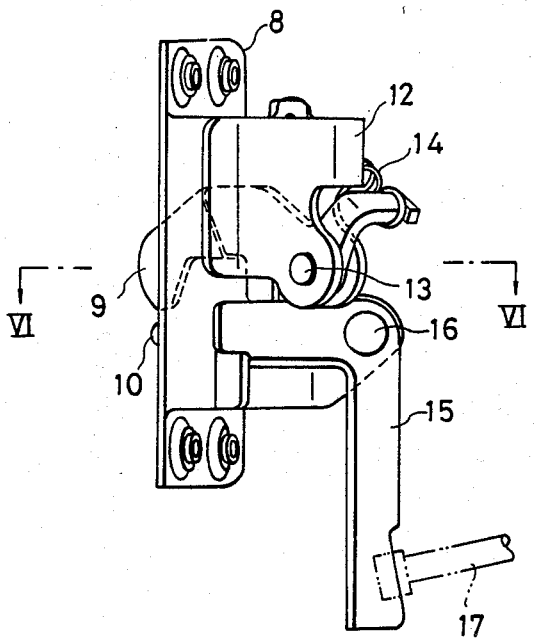
FIG. 5 is a perspective view of a door-side part of the forward door lock device as viewed obliquely forward.

FIG. 1 shows an external appearance of the vehicle to which the present invention is applied and FIG. 2 is a schematic view of a general formation of a door lock mechanism of the sliding door.

The general formation of the door lock mechanism will be described first.

The door lock mechanism comprises a door lock opening/closing operating device 2 which is provided on a sliding door side 1, a forward door lock device 3 and a rearward door lock device 4.

The door lock opening/closing operating device 2 has a locking/unlocking mechanism (not shown) which comprises a locking/unlocking lever, a knob lever, an opening lever (all of which are not shown) and the device 2 is operatively connected to an outside handle 5 which is provided on the external side of the sliding door 1, an inside handle 6 which is provided on the internal side of the sliding door 1 and a knob 7 which is provided also on the internal side of the sliding door 1.

The forward door lock device 3 and the rearward door lock device 4 are operatively connected to the not shown locking/unlocking mechanism in the door lock opening/closing operating device 2. When the locking-/unlocking mechanism is in an unlocking position, if the outside handle 5 or the inside handle 6 is operated, the locking of the forward door lock device 3 and the rearward door lock device 4 get released at the same time, allowing the sliding door 1 to be opened.

The forward door lock device 3 will now be described more specifically.

As illustrated in FIGS. 3 to 8, a base member 8 having a central recessed portion 8*a*, which projects rearwardly in its mounted position, is fixed on a front end face 1*a* of the sliding door 1. A hook member 9 which has a downwardly bent tip end portion and a guide pin 10 with a tapered tip end portion having a reduced diameter as compared with a stem portion of the pin 10 are mounted so as to project from the bottom of the recessed portion to extend generally forward.

The hook member 9 has a rear end portion which extends through an elongated slot 11 formed on the recessed portion 8*a* of the base member 8. The rear end portion of the hook member 9 is pivotably supported by a substantially horizontal pin 13 on a bracket 12 which is fixed to the base member 8 and urged towards a lower locking position (in a counterclockwise direction in FIG. 4) by a tension coil spring 14.

The rear end portion of the hook member 9 is engaged with a lever 15 which is pivotally supported by a pin 16 on the bracket 12 and the lever 15 is connected to the door lock opening/closing operating device 2 through a rod 17.

With this arrangement, it will be seen that when the outside handle 5 or the inside handle 6, each of which is connected to the door lock opening/closing operating device 2, is operated, the hook member 9 is rotated upwardly (in the clockwise direction in FIG. 4) against the action of the tension coil spring 14.

Numeral 18 shows a resilient cover which covers the elongated slot 11 formed on the recessed portion 8*a* of the base member 8 to prevent dusts or other foreign matters from entering the inside of the door 1, while leaving an opening for allowing the hook member 9 and the guide pin 10 to extend therethrough.

Figure 6:
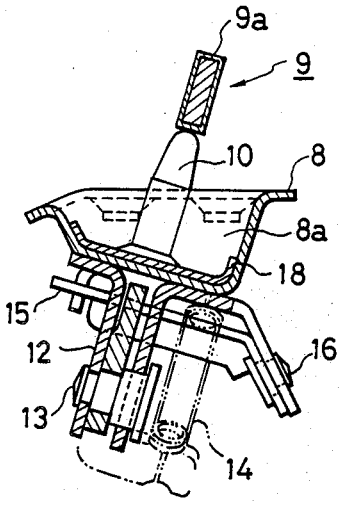
FIG. 6 is a horizontal cross sectional view of the door-side part of the forward door lock device taken along a line VI—VI.
Figure 7:
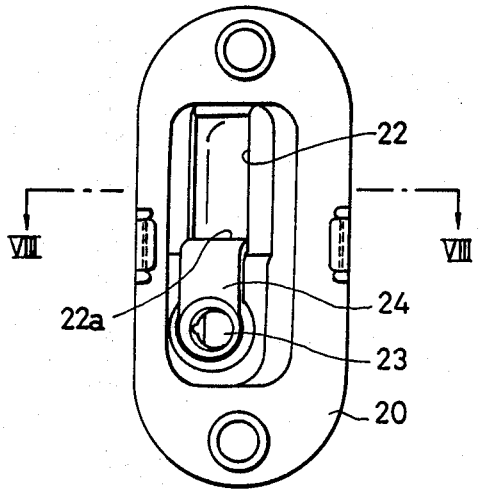
FIG. 7 is a view of the vehicle body-side part of the forward door lock device.
Figure 8:
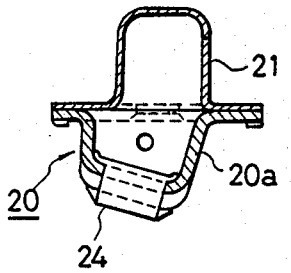
FIG. 8 is a horizontal cross sectional view of the vehicle body-side part of the forward door lock device taken along a line VIII—VIII.

The recessed portion 8*a* is formed as illustrated in FIG. 6. As can be seen from the figure, the recessed portion 8*a* is formed in such a manner that it is deeper in the inner end and shallower in the outer end. The wordings "inner" and "outer" herein used refer to the inner portion of the recessed portion 8*a* and the outer portion of the recessed portion 8*a*, respectively in the position where the base member 8 is mounted on the door 1. With this formation, the recessed portion 8*a* faces slantingly inwardly. As a result of this, the guide pin 10 fixed to the recessed portion 8*a* and the hook member 9 pivotally supported by the bracket 12 extend slightly towards the inside of the vehicle rather than extend straight in the forward direction.

This arrangement is to cope with the sliding door movement which moves slantingly rearward or forward when it opens or closes. With this arrangement, engagement with or release from a base member 20 of a door lock striker which is provided on the vehicle body will be facilitated.

The tip end portion of the hook member 9 which projecting from the base member 8 is covered by a molded member 9*a* of a rigid nylon synthetic resin material.

Another base member 20 having a central convexed portion 20*a* which projects rearwardly is mounted and fixed on a rear end face 19*a* of a front pillar 19 of the vehicle body at a position corresponding to and substantially aligned with the position where the base member 8 is mounted and fixed on the sliding door 1.

A cover member 21 which is projected forwardly at its central portion like a box is integrally fixed to the base member 20.

The base member 20 has, at the convexed portion 20*a* thereof, an engaging slot 22 into which the hook member enters and a guide slot 23 into which the guide pin 10 is inserted.

A nylon rigid synthetic resin material 24 is integrally molded and attached to cover the periphery of the guide slot 23 and a locking portion 22*a* formed at a lower edge of the engaging slot 22 where the hook member 9 locks. This synthetic material 24 serves to lower a frictional resistance and clattering noises caused when the guide pin 10 and the hook member 9 enter the respective slots.

After the molded synthetic resin material 24 is attached, the diameter of the guide slot 23 is substantially the same as or slightly larger than the outer diameter of the stem portion 10*a* of the guide pin 10. Thus, even when some divergence in vertical and horizontal positions of the door 1 is caused by a change with time or a long use, the guide pin 10 and the hook member 9 can be located in positions.

The convexed or projected portion 20*a* of the base member 20 is so formed that it is higher at the inner end and lower at the outer end. Thus, the projected portion 20*a* faces slightly outward and the engaging slot 22 and the guide slot 23 formed on the projected portion 20*a* face slantingly rearward.

With this arrangement, the projected portion 20*a* mates the recessed portion 8*a* of the base member 8 of the door 1 in parallel with each other. Likewise, the engaging slot 22 and the guide slot 23 allow the hook member 9 and the guide pin 10 to engage and disengage substantially in parallel.

When the sliding door 1 is closed, the projected portion 20*a* of the base member 20 fixed on the front pillar 19 is received or fitted in the recessed portion 8*a* of the base member 8 fixed to the sliding door 1, with the projected portion 20*a* intruding to some extent into the recessed portion 8*a*. At the same time, the hook member 9 and the guide pin 10 enter and engage with the engaging slot 22 and the guide slot 23 formed on the base member 20.

More particularly, as the guide pin 10 is thus guided, from its tapered tip end to its stem, to enter the guide slot 23, the sliding door 1 is closed, while being accurately positioned both vertically and horizontally. At this time, if a load is applied laterally or transversely to the sliding door 1 to deform or displace the door 1, the projected portion 20*a* of the base member 20 on the vehicle body and the recessed portion 8*a* of the base member 8 on the door engage with each other and they withstand the shock.

Further, if the door 1 is largely deformed to cause a rearward load to the door, the door 1 will not open easily because the hook member 9 engages the locking portion 22*a* formed on the engaging slot 22.

In addition, since the base member 20 on the vehicle body side is projected towards the door 1 and the base member 8 on the door side is concaved to form the recessed portion 8*a* so that the hook member 9 and the guide pin 10 project from the bottom of the recessed portion 8*a*, the lengths of the hook member 9 and the guide pin 10 extending from the front end face 1*a* of the door 1 can be reduced. This is desirable to assure the safety for passengers in their getting on and off the vehicle.

The position where to mount the fore door lock device of the present invention is not limited to the position as shown, so long as it is a forward position of the sliding door. Or, a plurality of door lock devices may be provided on the sliding door, if necessary.

Alternatively, the present invention may be applied to a door lock other than the sliding door lock as illustrated, for example, a back door lock which door opens vertically.

The relationship between the recessed portion and the projected portion provided so as to confront each other is not fixed and rather relative and it may be vice versa.

EFFECTS OF THE INVENTION

As described above, according to the present invention, when the door is in its closed position, not only the guide pin is inserted in the guide slot, but the hook member is engaged with the locking portion to attain a primary coupling of the door and the vehicle body. Further, the projected portion is engaged with the recessed portion to attain a secondary coupling for the safety against an accidental collision. Thus, dual reinforcement is provided.

As a result of this, the engagement between the door and the vehicle body is more positively strengthened and undesired easy opening of the door may be prevented more effectively. Thus, the reliability of the door lock can be improved.

In addition, even if displacement or positional divergence in the door is caused by a change with time, such positional divergence may be corrected and rattling may be prevented by the engagement between the guide pin and the guide slot.

Since the hook member and the guide pin are provided at the recessed portion to engage with the slots formed at the projected portion, the lengths of the hook member and the guide pin projected from the door end face are reduced. This is desirable to assure safety for passengers in their getting on and off the vehicle.

I claim:

1. A door lock system of a vehicle, comprising:

a door lock opening/closing device, operatively connected to operating means provided on a door of the vehicle;

a first member having a recessed portion, provided at either one of an end face of the vehicle body and an end face of the door which confront each other when the door is in its closed position; and a second member having a projecting portion, provided at the other of the end faces, said second member being formed to be received in said recessed portion of said first member;

the projecting portion comprising a guide slot and an engaging slot with a locking portion provided at an end thereof, the recessed portion having a guide pin with a tapered end portion which is formed so as to be guided into the guide slot and also having a pivotally supported hook member formed with a hook at an engaging end that is engageable with the engaging slot and is operatively connected to the door lock opening/closing device so as to lock the hook member at the locking portion.

2. A door lock system of a vehicle, comprising:

a door lock opening/closing device, operatively connected to operating means provided on a door of the vehicle;

a first member having a recessed portion, provided at either one of an end face of the vehicle body and an end face of the door which confront each other when the door is in its closed position;

a second member having a projecting portion, provided at the other of the end faces said second member being formed to be received in said recessed portion of said first member, the projecting portion comprising a guide slot and an engaging slot with a locking portion provided at an end thereof, the recessed portion having a guide pin with a tapered end portion which is formed so as to be guided into the guide slot and also having a pivotally supported hook member formed with a hook at an engaging end that is engageable with the engaging slot and is operative connected to the door lock opening/closing device so as to lock the hook member at the locking portion; and a molded rigid synthetic resin member which covers a periphery of the guide slot and the locking portion of the engaging slot.

3. A door lock system of a vehicle as claimed in claim 1, which is applied to a forward lock of a sliding door of the vehicle.

4. A door lock system of a vehicle, comprising:

a door lock opening/closing device which is operatively connected to operating means provided on a door;

a member having a recessed portion which is provided at either one of an end face of a vehicle body and an end face of a door which confront each other when the door is in its closed position; and a member having a projected portion which is provided at the other of the end faces and adapted to be received in said recessed portion, the projected portion having a guide slot and an engaging slot with a locking portion provided on an end thereof, the recessed portion having a guide pin with a tapered end portion which is adapted to be guided into the guide slot and a hook member which is engageable with the engaging slot and is operatively connected to the door lock opening/closing device to lock the hook member at the locking portion, the system being applied to a forward lock of a sliding door of the vehicle in which said sliding door further has a rearward lock which is also connected operatively to the door lock opening/closing device and said forward lock and said rearward lock are adapted to be released at the same time by the operation of the operating means of the door.

5. A door lock system of a vehicle as claimed in claim 3, in which said member having the recessed portion has an elongated slot at said recessed portion and said hook member has a rear end portion which extends through said elongated slot of the member, is rotatably supported by a pin at a bracket connected to the member and is urged toward a lock position.

6. A door lock system of a vehicle, comprising:

a door lock opening/closing device, operatively connected to operating means provided on a door of the vehicle;

a first member having a recessed portion, provided at either one of an end face of the vehicle body and an end face of the door which confront each other when the door is in its closed position; and a second member having a projecting portion, provided at the other of the end faces said second member being formed to be received in said recessed portion of said first member, the projecting portion comprising a guide slot and an engaging slot with a locking portion provided at an end thereof, the recessed portion having a guide pin with a tapered end portion which is formed so as to be guided into the guide slot and also having a pivotally supported hook member formed with a hook at an engaging end that is engageable with the engaging slot and is operatively connected to the door lock opening/closing device so as to lock the hook member at the locking portion, wherein said recessed portion is formed deeper in its inner end and shallower at its outer end so that the guide pin and the hook member extend slightly towards the inside of the vehicle and said projected portion is formed higher at its inner end and lower at is outer end so that the engaging slot and said guide slot face slightly outward, whereby said guide pin and said hook member may be engaged with and disengaged from said guide slot and said engaging slot, respectively, in parallel with each other, the lock system being applied to a forward lock of a sliding door of the vehicle portion, wherein said 7. A door lock system of a vehicle, comprising:

a door lock opening/closing device, operatively connected to operating means provided on a door of the vehicle;

a first member having a recessed portion, provided at either one of an end face of the vehicle body and an end face of the door which confront each other when the door is in its closed position; and a second member having a projecting portion, provided at the other of the end faces said second member being formed to be received in said recessed portion of said first member, the projecting portion comprising a guide slot and an engaging slot with a locking portion provided at an end thereof, the recessed portion having a guide pin with a tapered end portion which is formed so as to be guided into the guide slot and also having a pivotally supported hook member formed with a hook at an engaging end that is engageable with the engaging slot and is operatively connected to the door lock opening/closing device so as to lock the hook member at the locking portion, wherein said member having the projected portion has another projected member which projects in a direction opposite to that of said projected portion thereby to form a space for receiving the guide pin and the hook member, the lock system being applied to a forward lock of a sliding door of the vehicle.

8. A door lock system of a vehicle as claimed in claim 1, in which said guide pin has a tapered tip end portion and a stem portion.

* * * * *